US005267656A

United States Patent [19]

Nichols

[11] Patent Number: 5,267,656

[45] Date of Patent: Dec. 7, 1993

[54] DISPLAY STAND APPARATUS

[76] Inventor: David G. Nichols, 64 Boston Rd., Palmer, Mass. 01069

[21] Appl. No.: 907,291

[22] Filed: Jul. 10, 1992

[51] Int. Cl.[5] ..... A47F 7/00

[52] U.S. Cl. ..... 211/13; 211/189; 211/163

[58] Field of Search ..... 211/13, 189, 163; 248/902

[56] References Cited

U.S. PATENT DOCUMENTS

| | | | |
|---|---|---|---|
| 2,808,941 | 10/1957 | Foster | 211/163 |
| 3,710,476 | 1/1973 | Hollingsead et al. | 29/200 J |
| 3,777,895 | 12/1973 | Weinstein et al. | 211/163 |
| 3,884,357 | 5/1975 | Bloch | 211/163 |
| 4,126,366 | 11/1978 | Handler et al. | 211/163 |
| 4,586,619 | 5/1986 | Eckert | 211/189 |
| 4,614,272 | 9/1986 | Shelton et al. | 211/13 |
| 4,723,666 | 2/1988 | Nichols | 211/189 |
| 4,844,645 | 7/1989 | Rasmussen | 403/14 |

*Primary Examiner*—Mark Rosenbaum
*Assistant Examiner*—Chuck Y. Mah
*Attorney, Agent, or Firm*—Barlow & Barlow, Ltd.

[57] ABSTRACT

A display stand having identical top and bottom members having a plurality of panel member seats formed about their periphery. The seats have guide members and a lip which interlocks with a wall edge formed in each vertical panel member. Each vertical panel member is provided with suitable attachment means for mounting articles of merchandise to be displayed.

11 Claims, 3 Drawing Sheets

DISPLAY STAND APPARATUS

BACKGROUND OF THE INVENTION

This invention relates generally to apparatus for displaying merchandise for sale and more particularly, to a so-called knockdown-type display stand.

Display stands or racks for presenting various goods in a manner to promote their sale are well known and typically comprise one or more panels mounted on a base with the panels provided with some type of attachment means for holding the goods to be displayed.

An example of a prior art display stand is shown in U.S. Pat. No. 4,723,666 in which a plurality of panels, each formed with means to support articles, are joined together. A hinge having a slot is formed on one edge of each panel and a pin is formed on an opposite edge so that pin of one panel is lockingly received in the opening of an adjacent panel.

This display stand can be provided to the ultimate user, that is to the retailer, in a compact container who can then readily assemble the display rack which, in its assembled form, occupies considerable space.

Although the above-described display stand is effective, there is always a need for units that may be more easily assembled as well as a continuing desire to provide new, pleasing, clean and simple designs to display articles of merchandise in an effective manner.

It is an object of the present invention to provide a display stand for mounting a plurality of articles of merchandise in an attractive manner which can be shipped and stored in a compact container and which can easily and quickly be assembled by the user when ready for use. Another object is the provision of such a stand which can be assembled by individuals having little or no skill with minimal instruction.

Briefly, in accordance with the invention, identically formed top and bottom stand members have a plurality of panel receiving seats formed about their peripheries. The panel receiving seats comprise a pair of guide pins extending away from a face surface of the member generally perpendicular to the surface along with a tab dispose between the guide pins and also extending away from the face surface. A laterally extending lip is formed on the free distal end of the tab. A plurality of elongated, vertical panel members are formed with identical top and bottom walls, each wall having a pair of apertures having a size selected to closely receive the guide pins and being spaced apart the same distance as the guide pins along with an edge surface disposed between the apertures. A panel is placed on one stand member at each panel receiving seat with the guide pins received in the apertures of a wall and a force is exerted on the outer surface of the stand member in the vicinity of the tab until the lip of the tab passes beyond the respective edge surface of the panel member. The opposite stand member is then placed over the other wall of the panel members with the guide pins received in the apertures and a force is exerted on the outer surface of the stand member until each lip passes beyond the respective edge surface of the panel members to lock the members together. According to a feature of the invention, a cam surface is formed on the tab and the wall edge surface to facilitate attachment. According to another feature of the invention, the tab is formed on a rib between adjacent cut-out sections to facilitate pushing of a tab beyond the edge surface. According to yet another feature, the top and bottom stand members are formed with a lip about their peripheries having a configuration matching the shape of the assembled panel members and located relative to the guide pins to closely receive the respective ends of the panel members to add stability to the side walls of the panel members.

When the panel members are mounted in the display, the side wall of one panel member extends closely adjacent to the side wall of an adjacent panel member without having any direct connection therebetween.

Figure 1:
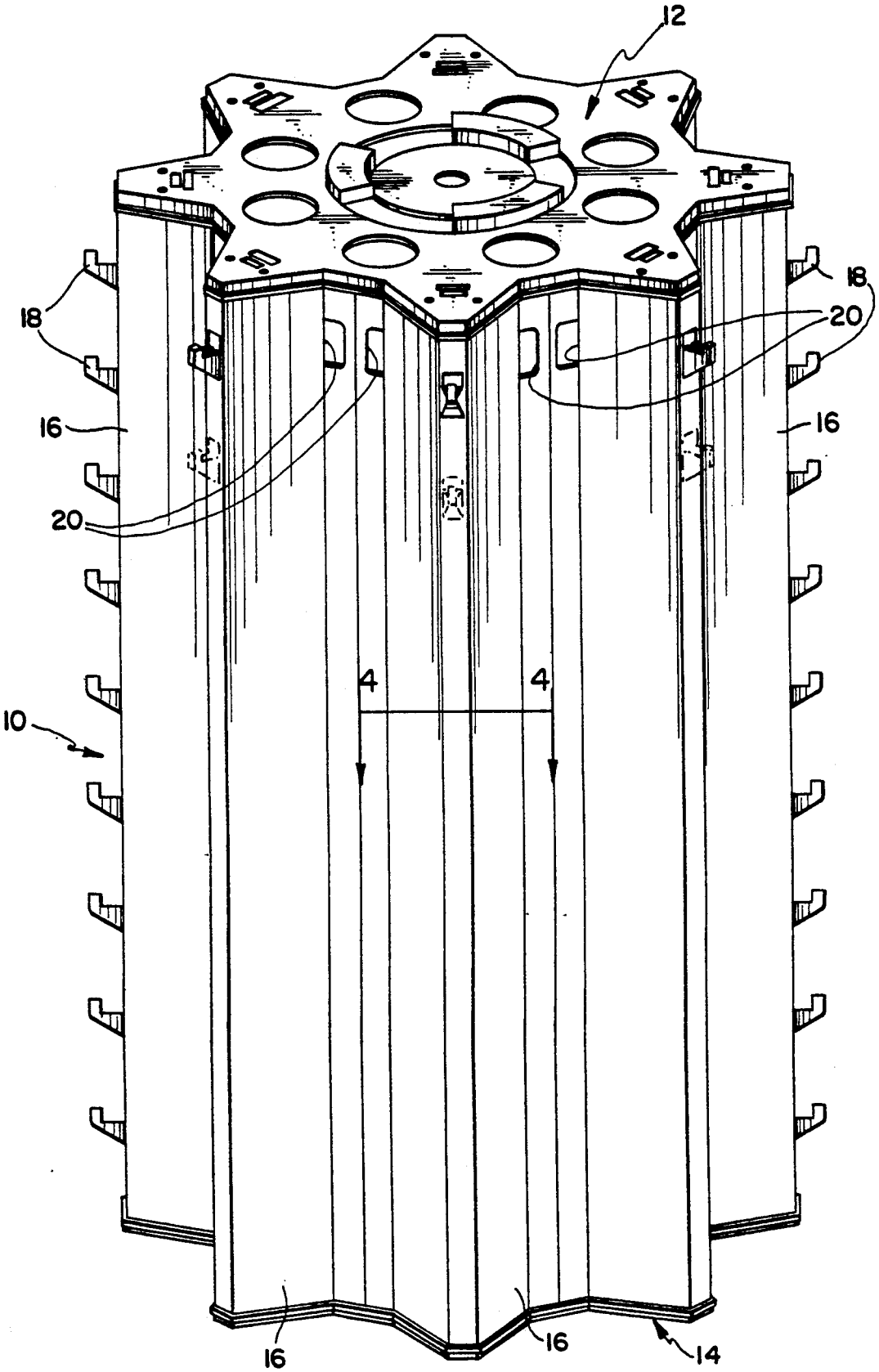
FIG. 1 is a perspective view of a display stand made in accordance with the invention in which an exemplary number of attachment means are shown.

Referring now to the details of the drawing, a display stand 10 comprises top and bottom stand members 12 and 14, respectively, with a plurality of vertical panel members 16 extending therebetween. The stand typically is mounted on a conventional base member (not shown) to allow rotational movement of the stand. The vertical panel members are formed with suitable attachment means for mounting selected articles of merchandise, such as hooks 18 and apertures 20, adapted to mount eyeglasses. An exemplary number of such hooks and apertures are shown in FIG. 1. It will be understood that the attachment means can take various forms depending upon the particular articles to be displayed.

Figure 2:
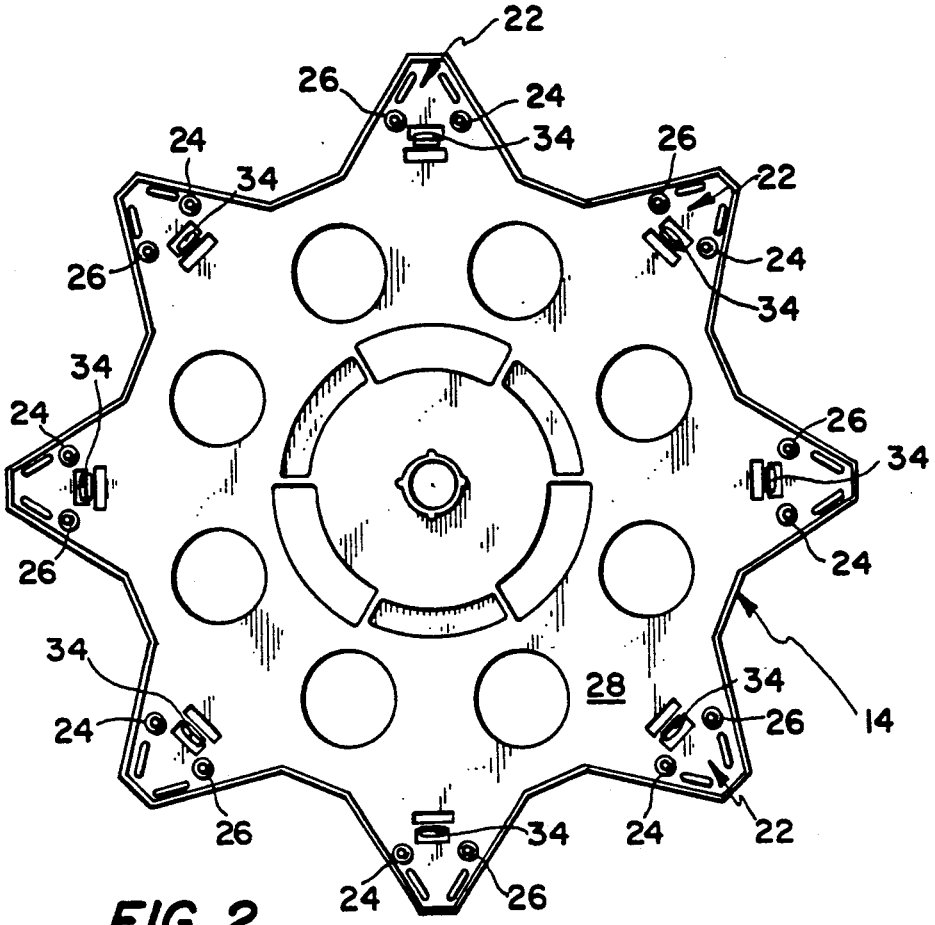
FIG. 2 is a top plan view of the bottom stand member.
Figure 3:
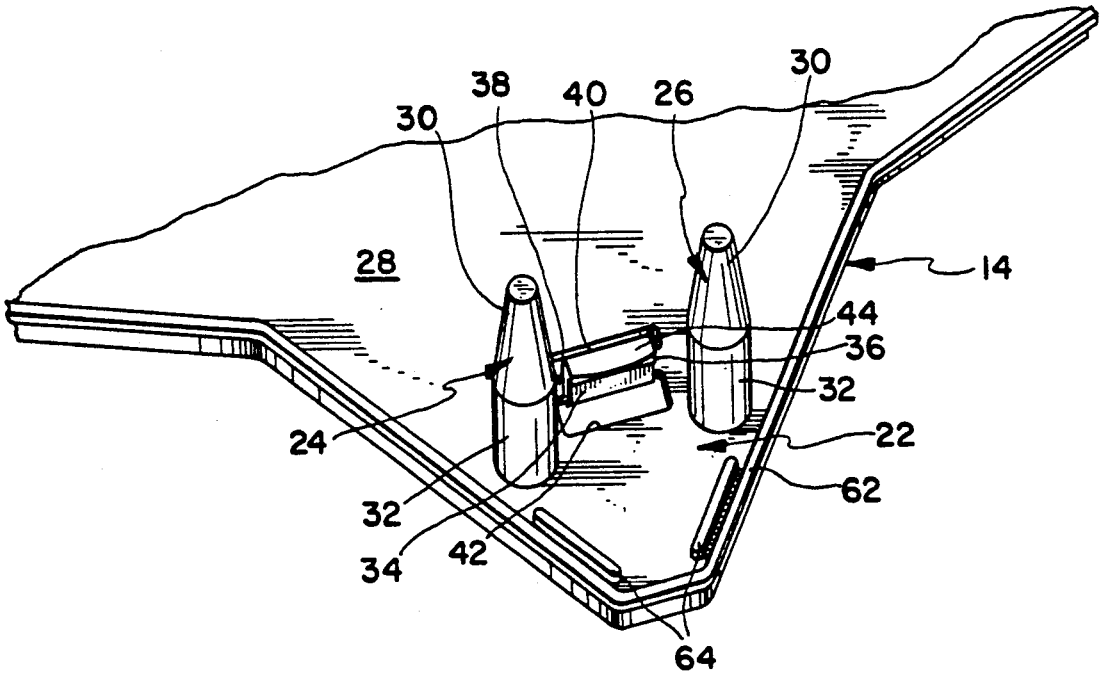
FIG. 3 is a perspective view of a vertical panel member seat of the bottom stand member.

With reference to FIG. 2, bottom stand member 14 is provided with a plurality of vertical panel member seats 22 spaced about the periphery of the member. Although the figure shows eight seats, it will be understood that the particular number chosen is a matter of choice. FIG. 3 shows one of the seats comprising a pair of guide pins 24, 26 extending away from face surface 28 in a direction generally perpendicular to the face surface. Guide pins 24, 26 have a conical or tapered outer surface portion 30 and a lower cylindrical portion 32. A tab 34 is disposed between the pair of guide pins and extends away from face surface 28 and has a lip 36 extending laterally from the free distal end of the tab. Tab 34 is preferably formed on a rib 38 formed between cut-out sections 40, 42 to facilitate attachment of member 14 to a vertical panel member as will be explained below. The outer surface 44 of lip 36 is preferably formed with a cam surface so that a downward force placed on the tab (as seen in FIG. 3) will urge the distal free end toward cut-out section 40.

Figure 4:
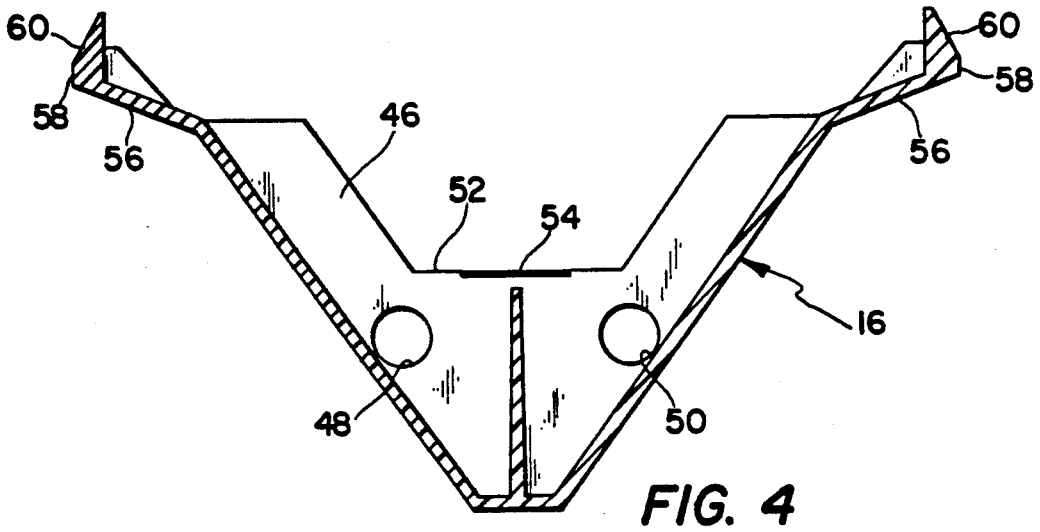
FIG. 4 is a sectional view taken through a vertical panel member showing an end wall which is adapted to be received on the seat of FIG. 3.
Figure 5:
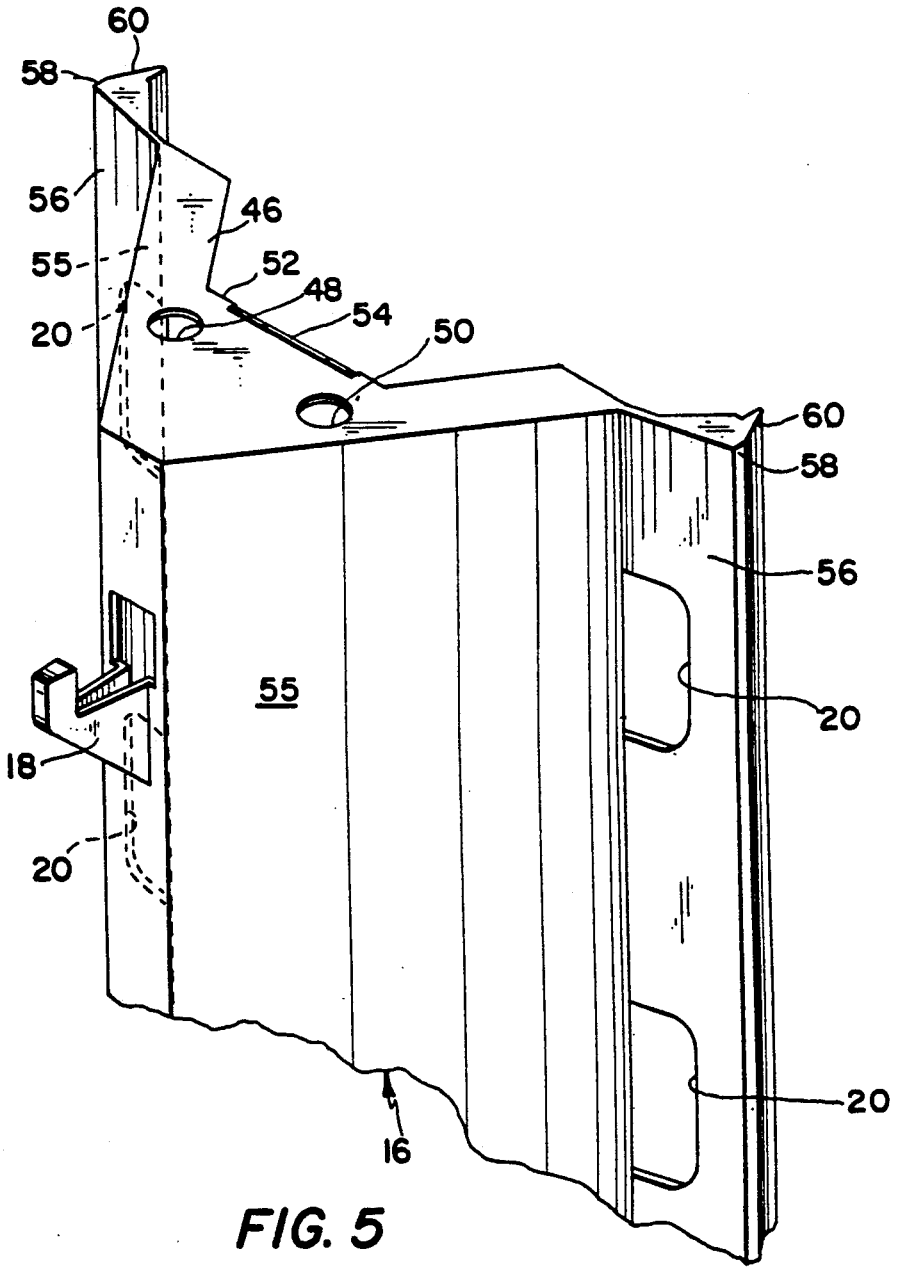
FIG. 5 is a perspective view of the top portion of a vertical panel member.

With reference to FIGS. 4 and 5, panel member 16 are formed with end walls 46 having a pair of circular apertures 48 and 50 and an edge surface 52 spaced from the apertures but extending in a direction parallel to a line joining the centers of the apertures. Preferably edge surface 52 is provided with a sloped or cam surface 54 adapted to mate with cam surface 44 of lip 34 when a panel is placed on a respective seat.

As used with the octagonal configuration of top and bottom stand members 12 and 14, panel members 16 are configured generally as a V-shape when seen in a section taken in a plane perpendicular to the longitudinal axis or length of the panel member. Hooks 18 are disposed at the convergence of the side walls 55 of the panel member and apertures 20 are formed in outwardly flared wall portions 56 extending from the end portions of the side walls 55. Wall portions 56 are formed with a bevel 58 and a flat edge portion 60 adapted to fit closely adjacent to a corresponding flat edge portion 60 of an adjacent panel member when the stand is assembled.

In assembling the stand, a vertical panel member 16, as seen in FIG. 4, is placed on a seat, as seen in FIG. 3, with guide pins 24, 26 received through apertures 48, 50 and a force is exerted through the member 14 in the vicinity of rib 38 causing the outer distal end of tab 34 to move toward cut-out portion 40 allowing edge surface 52 to pass beyond lip 38 to lock the members together. Member 14 is preferably formed with an upstanding lip 62 about the outer periphery configured in the same shape as the assembled vertical panel members to add stability to the panel members. If desired, stop surfaces 64 can be formed on face surface 28 to facilitate the placement of a positive retention force on end wall 46 by lip 36.

Once all the vertical panel members are attached to bottom 14, then top member 12 can be placed on the opposite end of the vertical panel members and attached in a similar fashion to complete the assembly.

The stand can be easily disassembled twisting a vertical panel member out of its respective seat and for this purpose, lip 36 can be formed with a curved outer edge as seen in FIG. 3 to facilitate release of the lip with such motion.

Although the invention has been described in connection with a specific form and embodiment thereof, it will be appreciated that various modifications other than the one described above, may be resorted to without departing from the spirit or scope of the invention as defined in the appended claims.

I claim:

1. A display comprising top and bottom members having an outer periphery, a plurality of vertical panel member seats adjacent to and spaced around the periphery, each seat comprising guide pin means projecting in a direction away from its respective seat, a tab disposed adjacent each guide pin means and extending in a direction generally parallel to the direction in which the guide pin means project, the tab having a distal free end formed with a laterally extending lip, and a plurality of vertical panel members having a longitudinal axis and a generally V-shape in a section taken perpendicular to the longitudinal axis, each panel member having a top and bottom end wall, aperture means formed in each wall adapted to receive therein the guide pin means of respective top and bottom members, the wall having an edge disposed in a selected location relative to the aperture means and adapted to be engaged by a lip of a respective seat when the guide pin means are inserted in the aperture means, the tab being deformable sufficiently to force the lip beyond the edge of the wall thereby permitting the lip and tab to snap into locking engagement with the wall, the panel members having attachment means for mounting selected articles thereon for display.

2. A display according to claim 1 in which the guide pin means comprises a pair of guide pins having a tapered outer end and the aperture means comprises a pair of apertures.

3. A display according to claim 1 in which a lip is formed about the periphery of the top and bottom members having the same configuration as the assembled ends of the vertical panel members and adapted to snugly receive vertical panel members.

4. A display according to claim 1 in which the tab is formed on a rib formed between two cut-out portions of a respective top and bottom member.

5. Display apparatus comprising top and bottom members having an outer periphery, a plurality of vertical panel member seats adjacent to and spaced around the outer periphery, each seat comprising a pair of guide pins projecting in a direction away from their respective seat, a tab disposed between each pair of guide pins and extending in a direction away from its respective seat, the tab having a distal free end formed with a laterally extending lip and a plurality of vertical panel members each having a top and bottom wall, a pair of apertures each having a center formed in each wall adapted to receive therethrough the guide pins of a respective top and bottom member, the wall having an edge extending in a direction parallel to a line extending between the centers of the apertures and adapted to be engaged by a lip of a respective seat when the guide pins are inserted through the apertures, the tab being deformable sufficiently to force the lip beyond the edge of the wall thereby permitting the lip to snap into locking engagement with the wall, the panel members having attachment means for mounting selected articles thereon for display.

6. Display apparatus according to claim 5 in which the tab is formed with a cam surface adapted to engage the wall edge.

7. Display apparatus according to claim 6 in which the edge is formed with a cam surface adapted to engage the tab.

8. Display apparatus according to claim 6 in which the cam surface has a curved outer surface with a central portion extending laterally from the tab a greater distance than the remainder of the cam surface.

9. Display apparatus according to claim 5 in which the edge is formed with a cam surface adapted to engage the tab.

10. Display apparatus according to claim 5 in which a lip is formed about the periphery of the top and bottom members having the same configuration as the assembled ends of the vertical panel members and adapted to snugly receive vertical panel members.

11. Display apparatus according to claim 5 in which the tab is formed on a rib formed between two cut-out portions of a respective top and bottom member.

* * * * *